US005181694A

United States Patent [19]

Collins

[11] Patent Number: 5,181,694

[45] Date of Patent: Jan. 26, 1993

[54] FLOOR COVERING INSTALLATION TOOL

[76] Inventor: Harvey C. Collins, 7143 S. River Rd., Marine City, Mich. 48039

[21] Appl. No.: 865,375

[22] Filed: Apr. 8, 1992

[51] Int. Cl.[5] ..... B66F 13/00

[52] U.S. Cl. ..... 254/133 R; 254/DIG. 4; 254/8 B; 254/129; 254/131

[58] Field of Search ..... 254/DIG. 1, DIG. 4, 254/1, 2 R, 8 B, 8 C, 133 R, 129, 131

[56] References Cited

U.S. PATENT DOCUMENTS

| | | | |
|---|---|---|---|
| 66,170 | 6/1867 | Patterson | 269/250 |
| 829,344 | 8/1906 | Larsen . | |
| 1,283,795 | 11/1918 | Kelley | 254/133 R |
| 1,483,004 | 2/1924 | MacDow | 254/133 R |
| 2,469,670 | 5/1949 | Thompson | 254/133 |
| 2,536,550 | 1/1951 | Hughes | 254/133 |
| 2,548,944 | 4/1951 | Chapman | 254/133 R |
| 2,786,649 | 3/1957 | Bottorff | 254/1 |
| 2,786,650 | 3/1957 | Bottorff | 254/134 |
| 2,910,270 | 10/1959 | Schultz . | |
| 3,081,066 | 3/1963 | Murawski | 254/93 |
| 3,391,905 | 7/1968 | Burns | 254/133 R |
| 3,426,752 | 2/1969 | Laico | 128/83 |
| 3,662,994 | 5/1972 | Johns | 254/93 R |
| 4,070,624 | 1/1978 | Taylor | 269/217 |
| 4,097,022 | 6/1978 | Taylor | 254/133 R |
| 4,194,726 | 3/1980 | Hance | 254/133 R |
| 4,756,509 | 7/1988 | Unger et al. | 254/8 B |
| 4,846,443 | 7/1989 | Collins et al. | 254/8 B |
| 4,899,985 | 2/1990 | Good | 254/8 B |

FOREIGN PATENT DOCUMENTS

| | | | |
|---|---|---|---|
| 2089763 | 6/1982 | United Kingdom | 254/133 R |

*Primary Examiner*—J. J. Swann

*Attorney, Agent, or Firm*—Harness, Dickey & Pierce

[57] ABSTRACT

A floor covering installation tool for raising and lowering furniture, partitions or the like has a frame, a raising and lowering mechanism and a lifting assembly. The frame or the lifting assembly has a portion which is positioned underneath the object to be lifted. The raising and lowering mechanism is actuated to raise or lower the object to be lifted. Upon raising the lifted object to a desired height, flooring or the like is positioned underneath the lifted object. After the flooring is positioned underneath the lifted object, the raising and lowering mechanism is activated to release the lifting mechanism and return it to its original position. Thus, the tool is ready to be reused to lift another desired object.

13 Claims, 3 Drawing Sheets

Fig-4
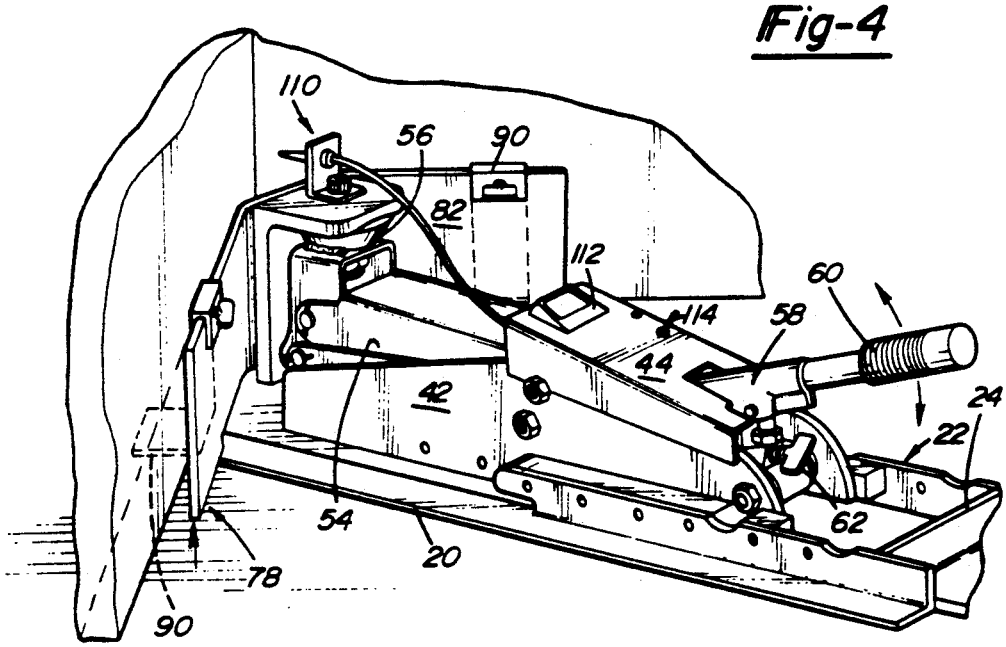
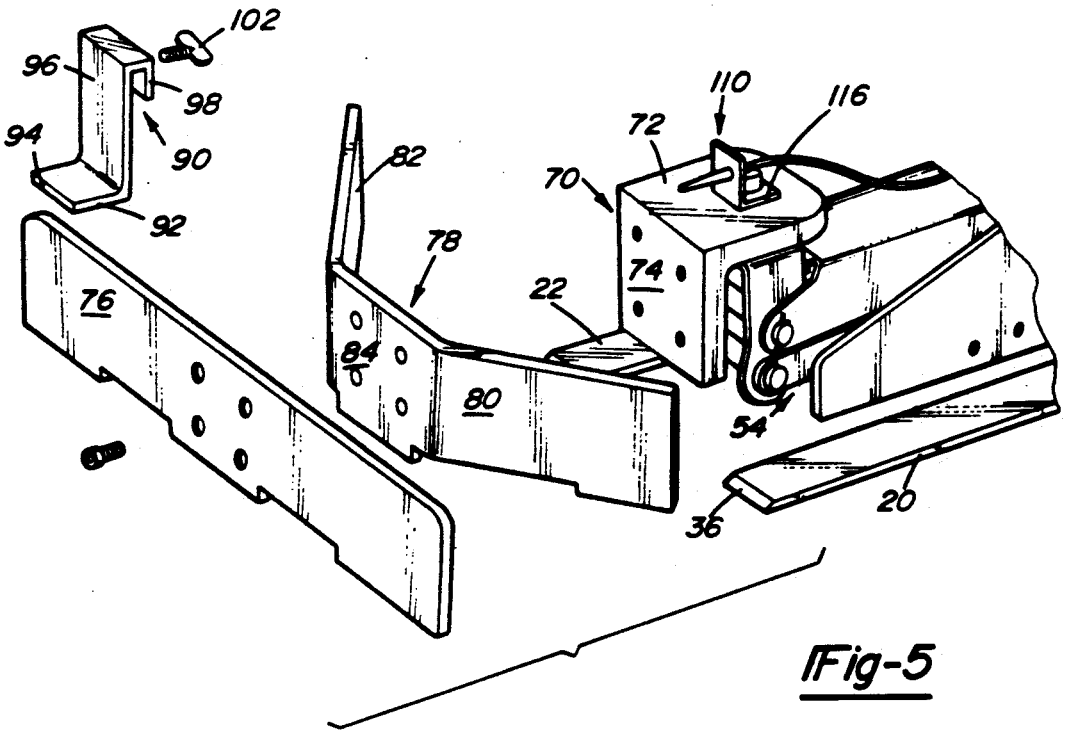
Fig-5

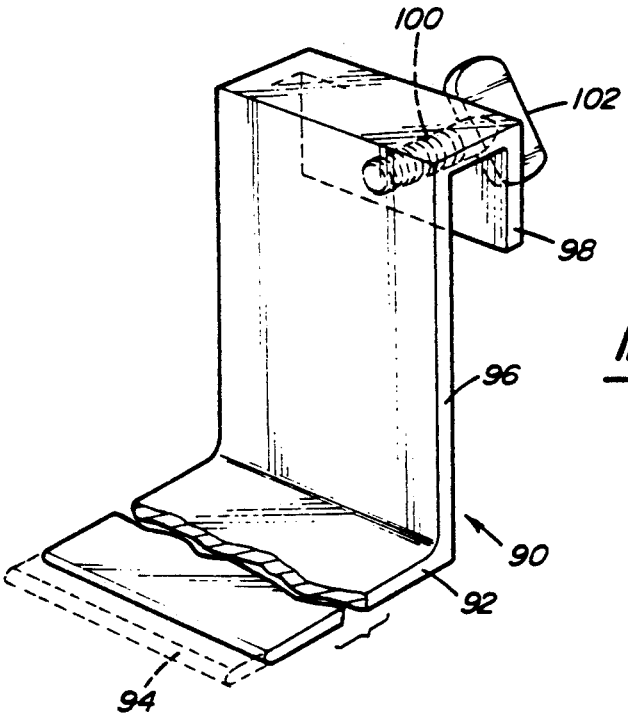
Fig-6
Fig-7
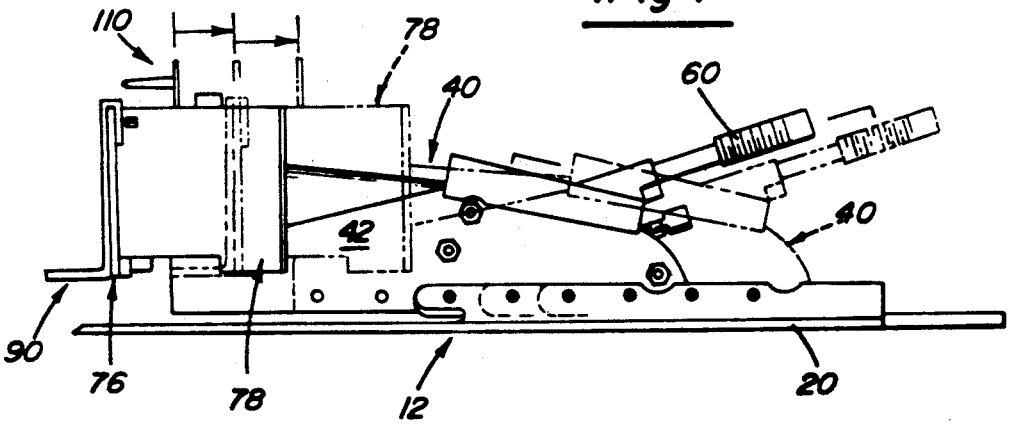
Fig-8
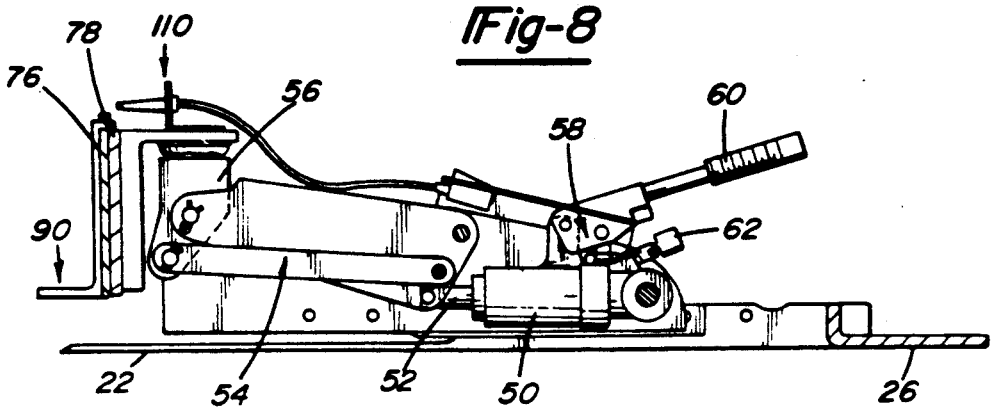

FLOOR COVERING INSTALLATION TOOL

BACKGROUND AND SUMMARY OF THE INVENTION

The present invention relates to installation of floor fitting furniture, partitions or like during the installation of the flooring.

During the installation of carpet, ceramic tile or the like in existing buildings where furniture, especially modular partitions, needs to be moved, the installer is faced with a recurring furniture moving dilemma. The installer may either move the furniture, partitions or the like by hand to one side of the room, install the carpet on that side of the room and move the furniture back onto the new flooring, install the remainder of the flooring and reposition the furniture. Another way is to position so that flooring may be positioned underneath the furniture, partition or the like.

A useful device for raising and lowering furniture, partitions or the lie is illustrated in my U.S.. Pat. No. 4,846,443, the specification and drawings of which are herein expressly incorporated by reference. This patent illustrates a lifting device for raising and lowering furniture, partitions or the like. While this invention provides the art with a satisfactory device for raising and lowering furniture, partitions or the like, designers continue to strive to improve the art.

Also, the following U.S. Pat. Nos. illustrate various types of lifting devices. The Pat. Nos. are: 66,170; 829,344; 2,469,670; 2,536,550; 2,786,649; 2,786,650; 2,910,270; 3,081,066; 3,426,752; 3,662,994; 4,194,726.

The present invention provides the art with an improved floor covering installation tool which lifts partitions, furniture or the like. The present invention enables installers to position flooring underneath furniture, partitions or the like without necessitating removal of the furniture from its original position within the room receiving the floor covering.

The present invention also provides a removable abutment member which enables the device to lift partitions or the like with a single planar surface or with two or more planar surfaces, such as a corner of a partition. The invention is also provided with movable lifting brackets to enable multi-positioning of the brackets with respect to the object to be lifted and also to move from one abutment member to the next. The present invention also includes a live current indicator to test for live current in the object to be lifted.

From the subsequent description and the appended claims taken in conjunction with the accompanying drawings, other objects and advantages of the present invention will become apparent to those skilled in the art.

BRIEF DESCRIPTION OF THE DRAWINGS

FIG. 3 is a side elevational view of the tool of FIG. 1 lifting a partition or the like.

FIG. 4 is a rear perspective view of the tool of FIG. 1 lifting a portion at a corner.

FIG. 5 is an exploded perspective view of the lifting assembly in accordance with the present invention.

FIG. 6 is an enlarged perspective view of a lifting bracket in accordance with the present invention.

FIG. 7 is a side elevational view similar to that of FIG. 3 illustrating multiple positions of the raising and lifting mechanism on the frame.

FIG. 8 is a side elevational view partially in section of FIG. 2 through line 8—8 thereof.

DETAILED DESCRIPTION OF THE PREFERRED EMBODIMENT OF THE INVENTION

Figure 1:
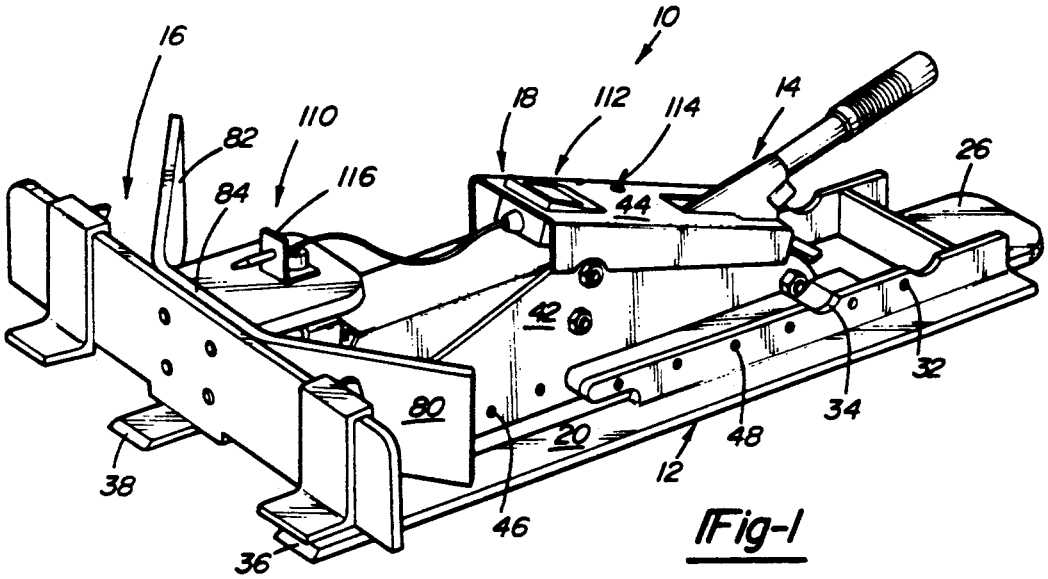
FIG. 1 is a front perspective view of an installation tool in accordance with the present invention.
Figure 2:
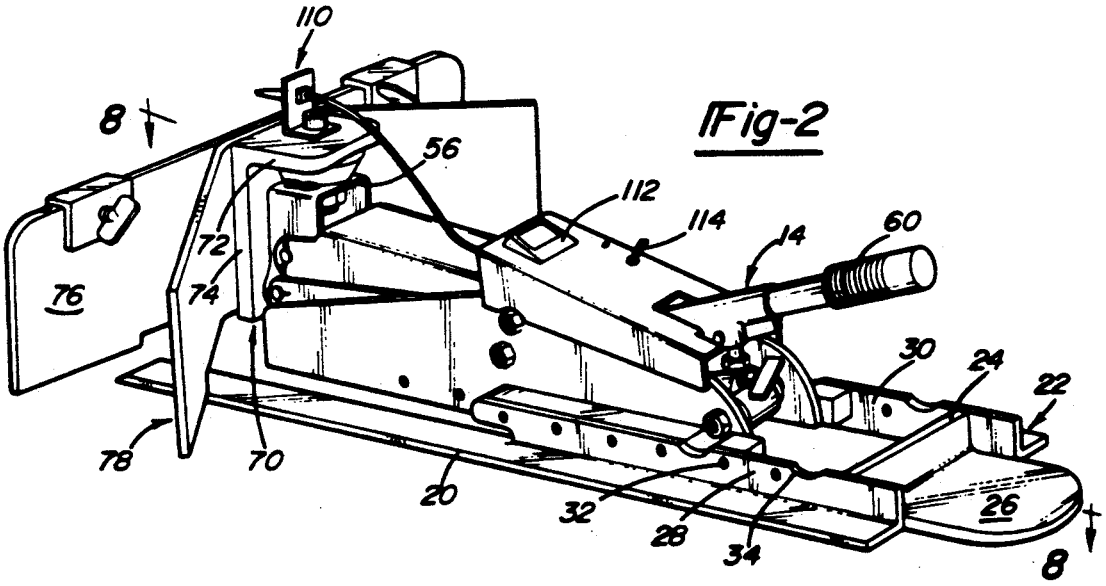
FIG. 2 is a rear side perspective view of the tool of FIG. 1.

Turning to the Figures, particularly FIGS. 1 and 2, a floor covering tool is illustrated and designated with the reference numeral 10. The tool 10 includes a frame 12, a raising and lowering mechanism 14 and a lifting assembly 16. Also, a live current indicator 18, which determines if live current is flowing in the object to be lifted, is associated with the tool 10.

The frame 12 is ordinarily U shaped, including a pair of legs 20 and 22 interconnected by a web 24. Ordinarily, the web 24 includes a foot plate 26 which enhances sliding of the frame 12 along a surface or the like. The legs 20 and 22 are mirror images of one another. Generally, the legs have flanges 28 and 30 with a plurality of apertures 32. Also, the flanges 28 and 30 include cut out portions 34. The apertures 32 and cut outs 34 enable multi positioning of the raising and lowering mechanism 14 along the frame 12, as can best be seen in FIG. 7. Also, the legs, 20 and 22, at their free extending ends, include a wedging surface 36 and 38 to enable the frame to be wedged under the object to be lifted. The wedging surfaces 36 and 38 are positioned underneath the object to be lifted, if necessary, to enable the initial raising of the object to be lifted.

The raising and lowering mechanism 14 includes a housing 40 with skirts 42 and a top 44. The skirts 42 include a plurality of spaced threaded apertures 46 which align with the apertures 32 of the frame to receive bolts 48 to secure the raising and lowering mechanism 14 to the frame 12. The housing 40 covers a cylinder 50 which has a piston rod 52 connected to a linkage 54 including a post 56 which is coupled with the lifting mechanism 16. An actuating assembly 58 including handle 60 is actuated by moving the handle in an up and down fashion which, in turn, raises the lifting mechanism 16. A thumb screw 62 is turned one way to enable the actuating mechanism 60 to raise the lifting mechanism and is turned in the opposite direction to release the fluid in the cylinder so that the lifting mechanism returns to its original position. This mechanism functions similar to that of a fluid jack system.

The lifting mechanism 16 includes a first member 70 secured to the post 56. The first member 70 generally has an overall L shape. The L is inverted with the horizontal leg 72 secured to the post 56 while the vertical leg 74 is secured to abutment members 76 and 78. Abutment member 76 has an overall rectangular planar shape and is removably secured to the first member 70. Abutment member 76 has its abutment surface substantially in a single plane. Abutment member 78 has an overall elongated V shape having a pair of legs 80 and 82 separated by a planar web 84. The web 84 enables the abutment member 78 to be secured to the leg 74 of the first member 70 as best seen in FIG. 5. The web section 84 is substantially rectangular and planar. Likewise, the legs 80 and 82 have an overall rectangular shape and are likewise planar. The legs 80 and 82 are in intersecting planes and the legs 80 and 82, and web 84 are in different planes. The design of the abutment member 78 enables lifting of partitions or the like at their corners as illustrated in FIG. 4.

Lifting brackets 90 are removably secured onto the abutment shape as seen in FIG. 6. The horizontal leg 92 of the bracket may be manufactured in varying lengths from two inches to sixteen inches. Likewise, the free end of the leg 92 may have a wedge member 94. The end of the second leg 96 not connected to the first leg 92, has a downturned flange 98 enabling the bracket to be positioned onto the abutment members. A threaded aperture 100 is located in the flange 98 to receive a thumb screw 102 to retain the bracket in position on the abutment members. The bracket 90 may be multi positioned along the abutment members. Likewise, a plurality of brackets may be positioned onto the abutment members. Also, the bracket members 90 may be moved from abutment member to abutment member.

The live current indicating mechanism 18 generally includes a sensing element 110 and a read out member 112. The current indicating mechanism 18 is generally battery operated. A switch 114 is moved from an off position to an on position to activate the mechanism 18. The sensor 110 is mounted by a bracket 116 onto the first member 70. The read out member 112 is generally mounted on the top 44 of the housing 40. When the current indicator is activated and the sensor 110 senses current in the object being lifted, the read out member 112 indicates voltage exists so that the installer is aware of the voltage in the lifted object.

Figure 3:
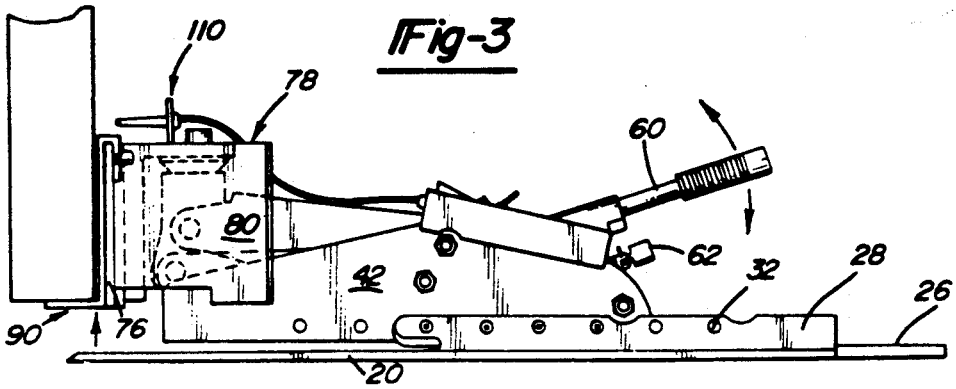

In lifting the object to be lifted, which may be furniture, partitions or the like, the brackets 90 and/or frame wedges 36 and 38 and a portion of the legs 20 and 22 are slid underneath the object to be lifted as seen in FIGS. 3 and 4. The frame leg ends remain positioned underneath the object The activation mechanism 58 is actuated, via up and down movement of the handle 60, as indicated in FIGS. 3 and 4, to raise the lifting assembly 16. The lifting assembly 16 raises the object to be lifted to a desired height. At that time, flooring or the like would be positioned underneath the object being lifted. After the flooring has been positioned underneath the lifted object, the thumb screw 62 is turned to enable the lifting mechanism to return to its original position. Also, the abutment member 76 may be removed from the lifting mechanism so that the corner abutment member 78 may be used to raise a partition or the like as illustrated in FIG. 4. The above would be followed to raise 4.

The abutment members 76 and 78 are easily removed from the first member 70 to provide the tool with a convertible lifting mechanism. The single plane abutment member 76 may be used along the sides of the furniture, partitions or the like, while the corner abutment member 78 is used in corner applications. Thus, a single machine may be utilized to lift a corner partition.

While the above detailed description describes the preferred embodiment of the present invention, the invention is susceptible to modification, variation, and alteration without deviating from the scope and fair meaning of the subjoined claims.

What is claimed is:

1. A tool for lifting furniture to enable installation of floor covering under the furniture partitions comprising:

a frame;

means for raising and lowering a lifting member, said raising and lowering means coupled with said frame and lifting assembly;

said lifting assembly including a first member coupled with said raising and lowering means a second member removably coupled with said first member and including a planar surface for providing an abutment surface for the furniture to be lifted, and a third member releasably coupled with said second member, said third member providing a lifting, surface, which faces the same direction as said planar surface and said third member being slidable along a length of said surface for providing a plurality of lifting positions.

2. The installation tool according to claim 1 wherein said frame includes a foot plate for enabling maneuvering of said tool.

3. The installation tool according to claim 1 wherein said lifting assembly includes a pair of third members.

4. The installation tool according to claim 1 wherein said raising and lowering means is movably adjustable with respect to said frame.

5. The installation tool according to claim 1 wherein said frame includes one or more wedging members for initially raising furniture to enable said third member to be positioned under the furniture.

6. The installation tool according to claim 1 wherein said third members include a plurality of third members, each having different lengths.

7. The installation tool according to claim 1 wherein said lifting assembly second member abutment surface is in a single plane.

8. The installation tool according to claim 1 wherein said lifting assembly second member abutment surface is in two or more planes.

9. The installation tool according to claim 1 wherein said lifting assembly includes a pair of second members, one second member having said abutment surface in a single plane and the other having the abutment surface in two or more planes, said second members being removably secured to said first member.

10. The installation tool according to claim 1 further comprising means for indicating electrical current, said indicating means associated with said lifting assembly.

11. A tool for enabling installation of floor covering under an object comprising:

a frame member;

means for raising and lowering a convertible lifting assembly, said raising and lowering means coupled with said frame member and said lifting assembly;

connecting means coupled with said raising and lowering means, said connecting means having a planar connecting surface;

said convertible lifting assembly including a first removable member having an abutment contact surface in a single plane for raising and lowering the object to be lifted said first member having a first connecting portion in said single plane for connecting with said planar connecting surface; and a second member having an abutment contact surface for raising and lowering an object to be lifted said second member having a second connecting portion in a plane parallel to said single plane or connecting with said planar connecting surface, said second connecting portion being at an angle tos aid second member abutment contact surface; and lifting means connectable to either of said first or second members for lifting said object; wherein said first member is removed to convert said tool from a first to a second lifting tool.

12. The installation tool according to claim 11 wherein said lifting means includes one or more removal lifting brackets movably positionable on said first and second members

13. The installation tool according to claim 11 further comprising means for indicating electrical current, said indicating means associated with said lifting member.

* * * * *

UNITED STATES PATENT AND TRADEMARK OFFICE

CERTIFICATE OF CORRECTION

PATENT NO. : 5,181,694

DATED : January 26, 1993

INVENTOR(S) : Harvey C. Collins

It is certified that error appears in the above-identified patent and that said Letters Patent is hereby corrected as shown below:

Column 1, lines 7-8, delete "fitting", insert --coverings and, more particularly, to a tool for raising and lifting--.

Column 1, after line 17, insert --raise the furniture, partitions or the like at its original--.

Column 1, line 22, "lie" should be --like--.

Column 1, line 66, "portion" should be --partition--.

Column 3, line 5, "shape" should be --members--.

Column 3, line 50, insert --and lower the corner partition like that illustrated in Figure--.

Column 4, line 13, "said surface" should be --said planar surface--.

Column 4, line 57, insert --;-- after "lifted", before "said first member".

Column 4, line 62, insert --;-- after "lifted", before "said".

Column 4, line 64, "or" should be --for--.

UNITED STATES PATENT AND TRADEMARK OFFICE

CERTIFICATE OF CORRECTION

PATENT NO. : 5,181,694

DATED : January 26, 1993

INVENTOR(S) : Harvey C. Collins

It is certified that error appears in the above-identified patent and that said Letters Patent is hereby corrected as shown below:

Column 4, line 67, "tos aid" should be --to said--.

Signed and Sealed this

Thirtieth Day of November, 1993

*Attest:*

*Attesting Officer*

Bruce Lehman

BRUCE LEHMAN

*Commissioner of Patents and Trademarks*

US005181694B1

REEXAMINATION CERTIFICATE (3605th)

United States Patent [19]

Collins

[11] B1 5,181,694

[45] Certificate Issued Aug. 18, 1998

[54] FLOOR COVERING INSTALLATION TOOL

[76] Inventor: Harvey C. Collins, 7143 S. River Rd., Marine City, Mich. 48039

Reexamination Request:
No. 90/004,901, Jan. 23, 1998

Reexamination Certificate for:

| | |
|---|---|
| Patent No.: | **5,181,694** |
| Issued: | **Jan. 26, 1993** |
| Appl. No.: | **865,375** |
| Filed: | **Apr. 8, 1992** |

Certificate of Correction issued Nov. 30, 1993.

[51] Int. Cl.[6] ..... B66F 3/00

[52] U.S. Cl. ..... 254/133 R; 254/133 R; 254/DIG. 4; 254/88; 254/129; 254/131

[58] Field of Search ..... 254/133 R, 131, 254/129, 1, 2 R, 8 B, 8 C, DIG. 1, DIG. 4

[56] References Cited

U.S. PATENT DOCUMENTS

| | | | |
|---|---|---|---|
| 66,170 | 6/1867 | Patterson | 269/250 |
| 829,344 | 8/1906 | Larsen . | |
| 1,283,795 | 11/1918 | Kelley | 254/133 R |
| 1,483,004 | 2/1924 | MacDow | 254/133 R |
| 1,916,476 | 7/1933 | Harbaugh et al. . | |
| 2,377,034 | 5/1945 | Pierce . | |
| 2,469,670 | 5/1949 | Thompson | 254/133 |
| 2,536,550 | 1/1951 | Hughes | 254/133 |
| 2,548,944 | 4/1951 | Chapman | 254/133 R |
| 2,786,649 | 3/1957 | Bottorff | 254/1 |
| 2,786,650 | 3/1957 | Bottorff | 254/134 |
| 2,910,270 | 10/1959 | Schultz . | |
| 2,973,184 | 2/1961 | Trautman et al. . | |
| 3,081,066 | 3/1963 | Murawski | 254/93 |
| 3,391,905 | 7/1968 | Burns | 254/133 R |
| 3,426,752 | 2/1969 | Laico | 128/83 |
| 3,662,994 | 5/1972 | Johns | 254/93 R |
| 4,070,624 | 1/1978 | Taylor | 269/217 |
| 4,097,022 | 6/1978 | Taylor | 254/133 R |
| 4,194,726 | 3/1980 | Hance | 254/133 R |
| 4,336,921 | 6/1982 | Weinhold . | |
| 4,756,509 | 7/1988 | Unger et al. | 254/8 B |
| 4,846,443 | 7/1989 | Collins et al. . | |
| 4,899,985 | 2/1990 | Good | 254/8 B |

FOREIGN PATENT DOCUMENTS

| | | |
|---|---|---|
| 2060557 | 9/1980 | United Kingdom . |
| 2089763 | 10/1981 | United Kingdom . |

*Primary Examiner*—Robert C. Watson

[57] ABSTRACT

A floor covering installation tool for raising and lowering furniture, partitions or the like has a frame, a raising and lowering mechanism and a lifting assembly. The frame or the lifting assembly has a portion which is positioned underneath the object to be lifted. The raising and lowering mechanism is actuated to raise or lower the object to be lifted. Upon raising the lifted objct to a desired height, flooring or the like is positioned underneath the lifted object. After the flooring is positioned underneath the lifted object, the raising and lowering mechanism is activated to release the lifting mechanism and return it to its original position. Thus, the tool is ready to be reused to lift another desired object.

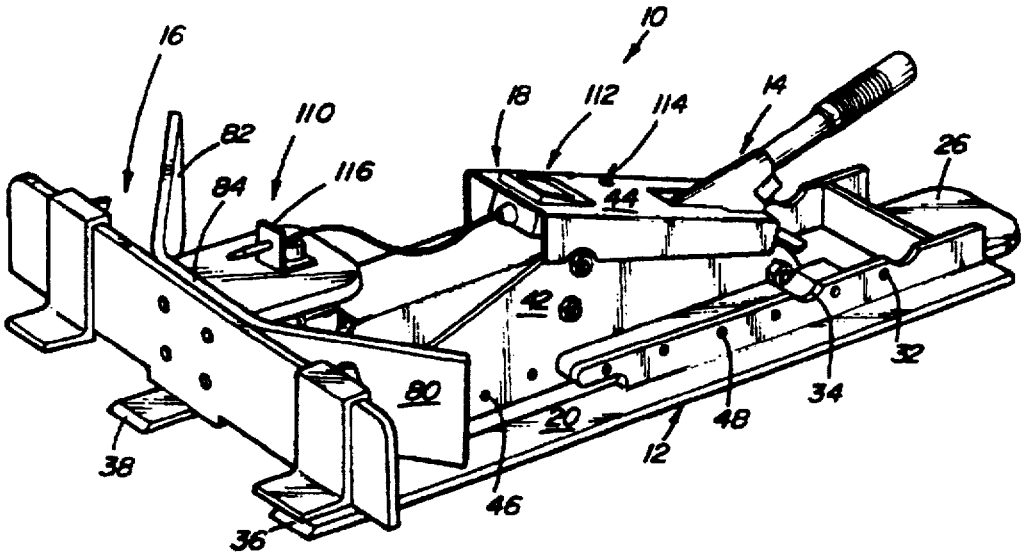

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–12 and 13 is confirmed.

* * * * *